US005154678A

United States Patent [19]

Adamczyk et al.

[11] Patent Number: 5,154,678

[45] Date of Patent: Oct. 13, 1992

[54] COMBINED EXERCISE PLATFORM

[75] Inventors: George R. Adamczyk, Chagrin Falls; James F. Smith, Louisville; Robert R. Schnabel, Jr., Navarre; M. Diane S. McAndrew, Canton, all of Ohio

[73] Assignee: Consumer Direct, Inc., Canton, Ohio

[21] Appl. No.: 820,361

[22] Filed: Jan. 14, 1992

[51] Int. Cl.[5] ..... A63B 22/00

[52] U.S. Cl. ..... 482/52; 108/157

[58] Field of Search ..... 482/52; 248/346; 108/901, 157, 43; 297/438, 439; 211/188, 194

[56] References Cited

U.S. PATENT DOCUMENTS

| | | | |
|---|---|---|---|
| 2,278,894 | 4/1942 | Paulson | 46/25 |
| 2,500,425 | 3/1950 | Morris | 35/29 |
| 3,599,750 | 8/1951 | Serwer | 182/15 |
| 4,053,558 | 9/1962 | Challas et al. | 287/119 |
| 4,340,218 | 7/1982 | Wilkinson . | |
| 4,606,278 | 8/1986 | Shuert | 108/901 X |
| 4,648,593 | 3/1987 | Wilkinson | 482/52 |
| 4,832,355 | 5/1989 | Hung | 280/32.5 |
| 5,005,702 | 4/1991 | Davis et al. | 108/43 X |
| 5,037,084 | 8/1991 | Flor | 482/52 |
| 5,050,861 | 9/1991 | Thomas et al. | 482/52 |
| 5,088,416 | 2/1992 | Reckermann et al. | 108/901 X |

FOREIGN PATENT DOCUMENTS

| | | | |
|---|---|---|---|
| 901614 | 5/1972 | Canada | 272/30 |

OTHER PUBLICATIONS

Bodyshaping Aerobic Stair, Distributed by Weider The Total Fitness Company.

Register Ring The Step and Step II.

SuperStep by SLM Inc. of RD1, Patch Rd., P.O. Box 1070, Gloversville, NY 12078.

*Primary Examiner*—Gene Mancene

*Assistant Examiner*—L. Thomas

*Attorney, Agent, or Firm*—Michael Sand Co.

[57] ABSTRACT

This invention relates to an improved adjustable exercise device for use in step benching which utilizes a combination of a two-piece bench step providing both a lower riser step as well as a higher riser step, the two units having an interlocking feature and lightweightness for a stable broad non-slip load-supporting surface which may be approached from any direction and may be readily assembled and disassembled as desired. The step heights may be varied between the 4 inch and 6 inch step heights which are preferred for the several most desirable levels of step benching. In a modified embodiment another base member is innerlocked with the two-piece bench to increase the vertical height of the top support surface.

23 Claims, 10 Drawing Sheets

COMBINED EXERCISE PLATFORM

BACKGROUND OF THE INVENTION

1. Technical Field

The present invention relates to an exercise device, and more particularly, to a combined adjustable exercise platform for use in step-aerobic exercises which are also called step-training or benching.

2. Background Information

During the recent past, substantial numbers of people have participated in high-impact aerobic training which has included running and jumping, both individually and in groups or classes. However, it has been noted that extensive participation in continuing high-impact aerobic training has caused significant damage to the hip, knee and ankle joints of the human body. The more recent development of stepaerobics or so-called "benching" has become an advantageous low-impact alternative to high-impact aerobics. The development of benching has included the most desirable elements of aerobic exercise which include stair climbing and running in place, wherein the participant must utilize his hands and feet in an improved coordinated manner as he or she steps up and down from a bench step of varied height. The benching is normally done to music or in timed rhythm for best results. Thus, benching exercise permits the participant to obtain a level of fitness comparable to that obtained through high-impact aerobics without incurring the deleterious excessive wear and tear on the lower body of the participant. In addition, benching provides a comparable level of fitness training as high-impact aerobics in generally equivalent periods of time.

In order to practice the benching exercise, a bench step device is needed. Originally, the bench step consisted of plastic milk crates or wooden boxes having a fixed height which lacked vertical height adjustment. It is known that the elevation of the bench step determines the degree of difficulty of step aerobics. The higher the vertical elevation of the step, the more strenuous the exercise and it is highly desirable to be able to vary the step height.

The prior art has disclosed various types of step-climbing exercise equipment having adjustable step heights. However, many forms of such equipment limited the participant to stepping onto and from the device only along a single access plane or axis. Also, many such types of exercising equipment were not readily transportable and involved the attachment of restraining mechanisms to the participant's ankles. Some forms of such equipment have utilized pins or rods inserted through openings in a supporting frame to control the vertical height of the stepping platform. In addition, prior equipment has involved adjustable tables which have been unstable for use during benching. None of the prior art has taught the use of a combined device which provides several steps of preferred vertical height for both the beginning participant as well as the advanced participant of benching exercise. The lower step for the beginner is for a participant having a lesser degree of fitness while the higher step is for an advanced participant having a higher degree of fitness.

U.S. Pat. No. 5,050,861 to Thomas discloses an adjustable bench step which utilizes an upper platform insertable into a hollow base which employs interior supports or stops which are placed in various interior positions to vary the vertical elevation of the platform in accordance with the position of the inner supports or stops. Also, U.S. Pat. No. 3,743,283 to Garrett, and U.S. Pat. Nos. 4,648,593 and 4,340,218 to Wilkinson relate to benching equipment which either limit the participant to benching on a single axis or a resilient-type exerciser for stimulating climbing. In addition, U.S. Pat. No. 2,599,020 to Saftrom and U.S. Pat. No. 4,106,403 to Hoagland both relate to adjustable tables which are relatively unstable during benching exercise.

There also is presently on the market other types of exercise benches consisting of an upper platform having separate steps which are stacked one on top of the other and are mounted beneath the ends only of the upper platform to adjust the vertical height thereof. Another type has an upper platform with four individual corner mounted legs which depending upon the manner in which the legs are mounted to the base will provide different height adjustments. Still another type consists of a top platform which can be mated or stacked upon an identical second platform to adjust the vertical height of the exercise platform.

SUMMARY OF THE INVENTION

The present invention provides an improved exercise device for use in step benching which utilizes a combined two-piece bench step which provides both a lower step having a preferred height for beginners of benching as well as a second higher step when the unit is combined in stacked relation for practicing a more advanced form of benching for participants having a greater degree of fitness for the exercise. As stated, increasing the vertical height of the step depending upon fitness level increases the difficulty of the exercise for the participant which produces improved conditioning benefits without the deleterious effects of high-impact aerobics.

It is an object of the present invention to provide an exercise device for use in benching, the device being comprised of two interlocking stable components, one of which may be used alone to provide a preferred first riser step, and the two of which can be readily combined in stacked relation to provide a second higher riser step for the participant.

Another object of the present invention is to provide a step-benching two-piece combined structure of simplified construction which is lightweight and provides a stable strong non-slip upper surface which can be varied in height between preferred lower and higher riser steps, the combined structure consisting of separate interlocking hollow top and bottom members which may be readily stacked and unstacked for desired end use.

A further object of the present invention is to provide an adjustable combined bench-stepping device in which the bottom member is a single continuous member which extends completely beneath the top member to provide an extremely stable device for practicing benching from any direction and having substantially vertical smooth sidewalls, both components being formed from blow-molded plastic material for lightweightness and ready transportability.

A still further object of the present invention is to provide a combined bench stepping device formed of two blow-molded plastic components, the top member being capable of individual use and the two components when combined in stacked interlocking relation providing a higher riser step for more advanced exercising.

A further object of the invention is to provide a combined bench step having positively interlocking interior structures for preventing their lateral or rotational movement when stacked, the top component being capable of individual use and the combined components providing a more strenuous bench step for advanced participants, both components having non-slip lower surfaces for individual use of the top component and combined use of the several components.

Another objective is to enable a third member to be interlocked on the bottom of the two piece structure to increase the height of the structure for more advanced users.

These objectives and advantages are obtained by the improved exercise platform of the present invention, the general nature of which may be stated as including a rectangular hollow top member of substantial thickness having a generally planar upper surface and substantially double-thickness integral hollow peripheral vertical sidewalls with a plurality of internal hollow recesses therein and a hollow central portion extending throughout the vertical extent of said top member beneath said upper surface providing a weight-supporting first riser step of said platform capable of individual use, and a complemental rectangular hollow bottom member having double-thickness integral hollow peripheral vertical sidewalls providing a weight-supporting second riser step of said platform and having at least one pair of upstanding horizontal rib members adapted to telescopically engage within said internal recesses in said top member providing an interlocked structure when stacked with said top member.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

For convenience, the present invention will be described as applied to a two-component exercise platform 10 including a top member 11 and a bottom member 12, which are both preferably formed of plastic, preferably of a high-impact high-density polyethylene plastic. Both components may be formed separately by blow-molding within two individually shaped blow molds, both components formed from either preshaped parisons, which are preshaped and enclosed within the final blow-molds, or from two sheets of plastic material having an essentially uniform thickness of about ⅛ inch. If desired the components could be made by injection molding of two halves, which are later combined into a single structure. The two components are adapted to be stacked one upon the other as shown in FIG. 1 of the drawings to facilitate shipment and to be locked together by the user as desired to constitute a unitary device.

Figure 11:
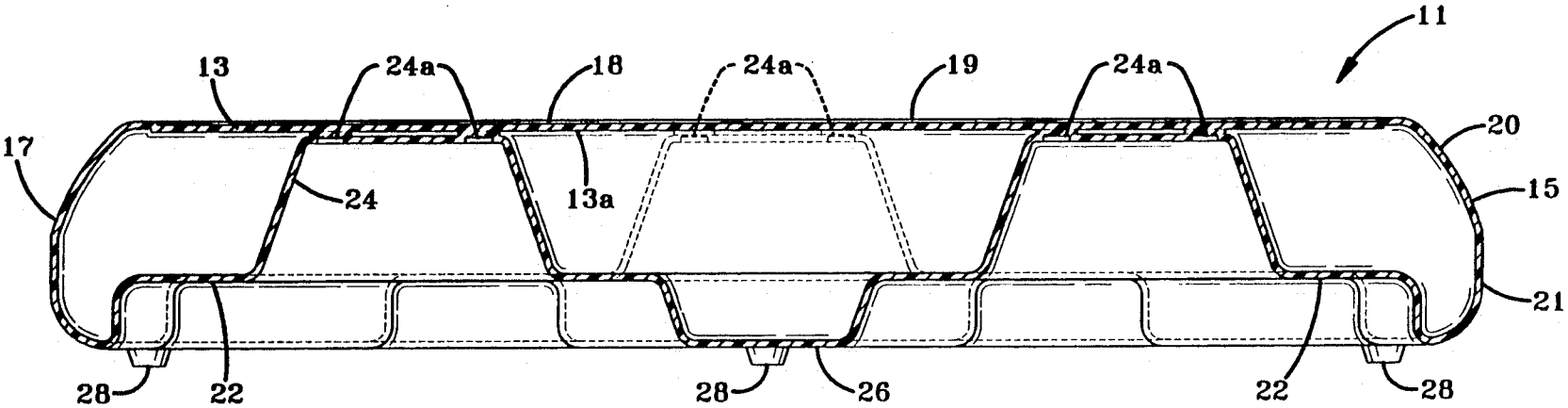
FIG. 11 is an enlarged fragmentary sectional view of the top platform taken along line 11—11, FIG. 3.
Figure 12:
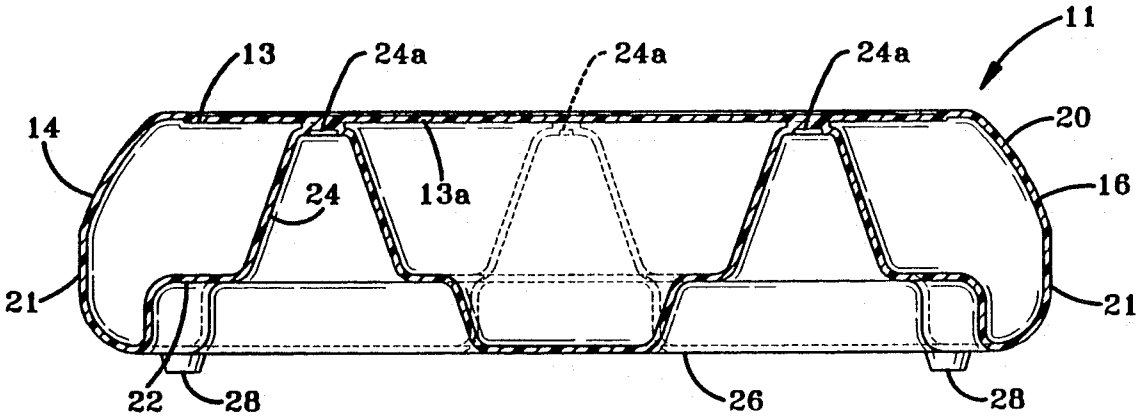
FIG. 12 is an enlarged sectional view of the top platform taken on line 12—12, FIG. 3.

The top platform or member 11 has a hollow body portion with an essentially planar rectangular upper surface 13 and smoothly-curved downwardly-extending peripheral sidewalls 14, 15, 16 and 17 which are hollow (FIGS. 11 and 12). The integral sidewalls have an essentially double-walled thickness which taper downwardly and vertically to provide a planar lower surface which is joined to the planar upper surface of the bottom member in face-to-face relation as described hereinafter, and shown in FIG. 17.

Initially, the top member 11 will be described in greater detail in view of its either individual or combined use with the base or bottom member 12 to provide either the first lower riser step or the second higher riser step of the platform. As aforesaid, both top and bottom members may be formed of lightweight plastic material to facilitate their ready transport and assembly for use in either an individual or combined manner for use by exercise participants of varying fitness levels.

Figure 1:
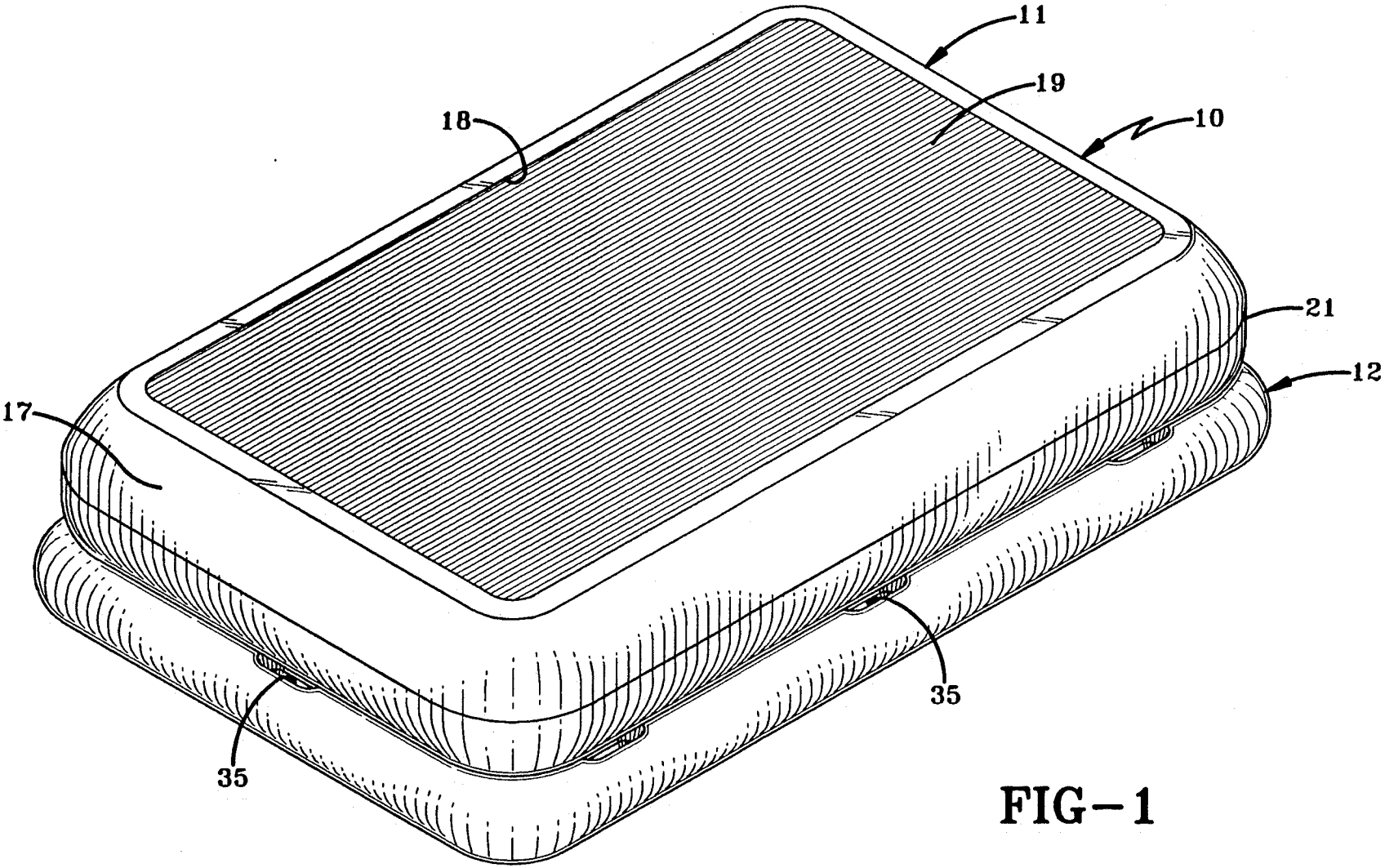
FIG. 1 is a perspective view of the improved exercise platform in assembled stacked condition.

The combined exercise platform 10 is shown in FIG. 1 in assembled relation, the upper or top member 11 being securely mounted on bottom member 12 in uniform vertical alignment therewith. The top member has an essentially planar upper wall surface 13 which is generally horizontal and rectangular in shape, the top member being surrounded by contiguous double-walled hollow vertical sidewalls 14, 15, 16 and 17. The vertical sidewalls are formed having substantial thickness and height with a hollow interior which may be readily formed by blow-molding. Sidewalls 14 and 16 comprise the longitudinal extent of the top member while sidewalls 15 and 17 are similarly shaped and comprise the shorter dimension of the top member.

Figure 2:
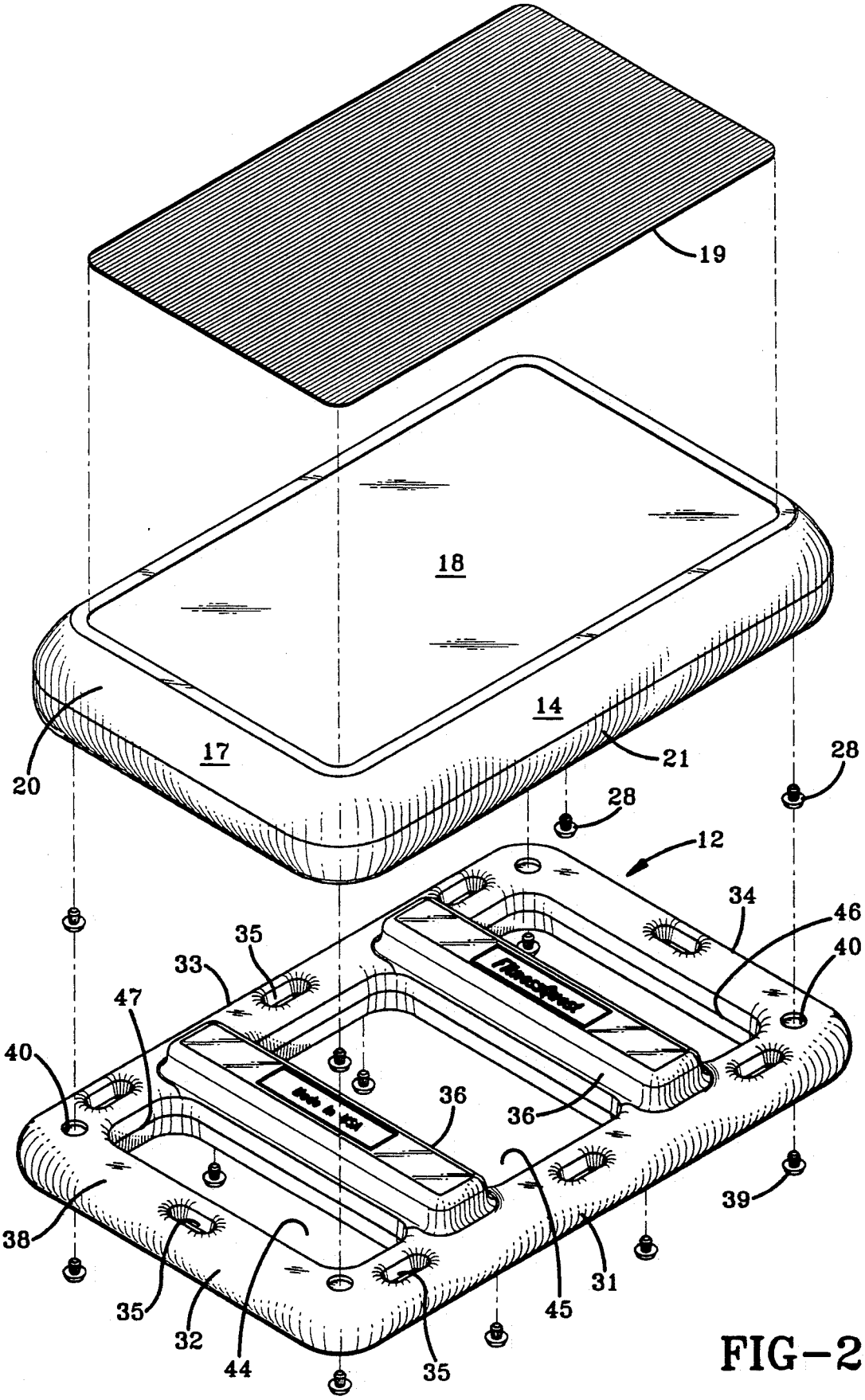
FIG. 2 is an exploded perspective view of the exercise platform of FIG. 1.
Figure 3:
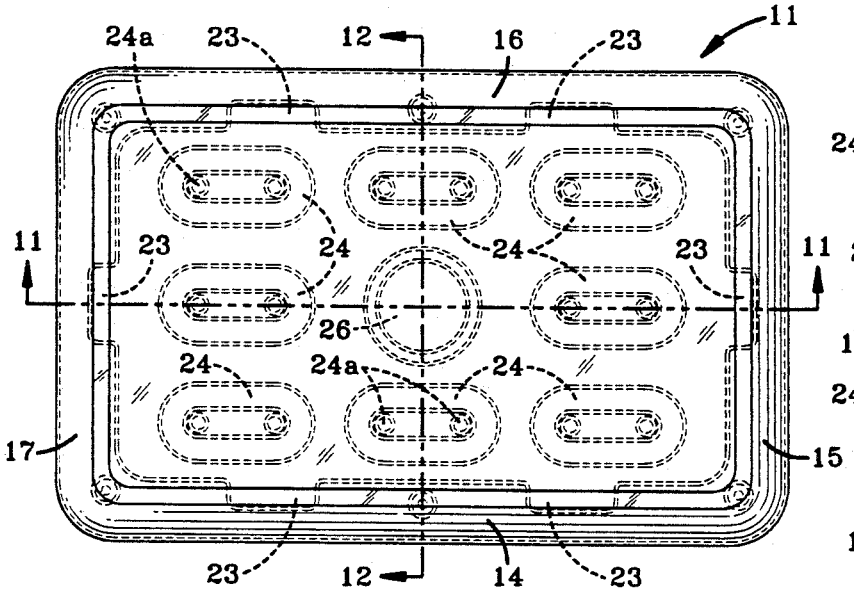
FIG. 3 is a top plan view of the top platform.

Top member 11 is shown in an exploded view in FIG. 2 having a shallow hollow upper recess 18 formed in top surface 13 which is rectangularly shaped and into which a ribbed thin non-slip mat 19 of elastomeric material is securely mounted such as by an adhesive, to provide a non-slip upper surface. The mat has a uniform thickness and fits within the shallow recess to provide an essentially smooth flush upper surface as shown in FIGS. 11 and 12, to ensure firm footing of an exercise participant. The horizontal top surface is sufficiently broad to receive one or both feet of the participant with equal access from any direction. Also the recess mounting of mat 19 completely within the flat top surface of member 11 eliminates exposed edges of the mat and curved areas which are difficult to maintain bonded to the platform.

The sidewalls have a downwardly and outwardly extending upper tapered surface 20 and a downwardly-extending vertical surface 21. The top member 11 has a preferred overall vertical height of about 4 inches to constitute a most desirable lower first riser step of the device. All four sidewalls of the top member are hollow and similarly shaped in cross-section as well as integral with each other and with the upper surface to form smoothly rounded corners of modern design. An inner intermediate planar surface 22 of the top member 11 is located in a plane substantially equal to the plane of transition from tapered to vertical of the sidewall exterior surfaces 20 and 21.

Figure 6:
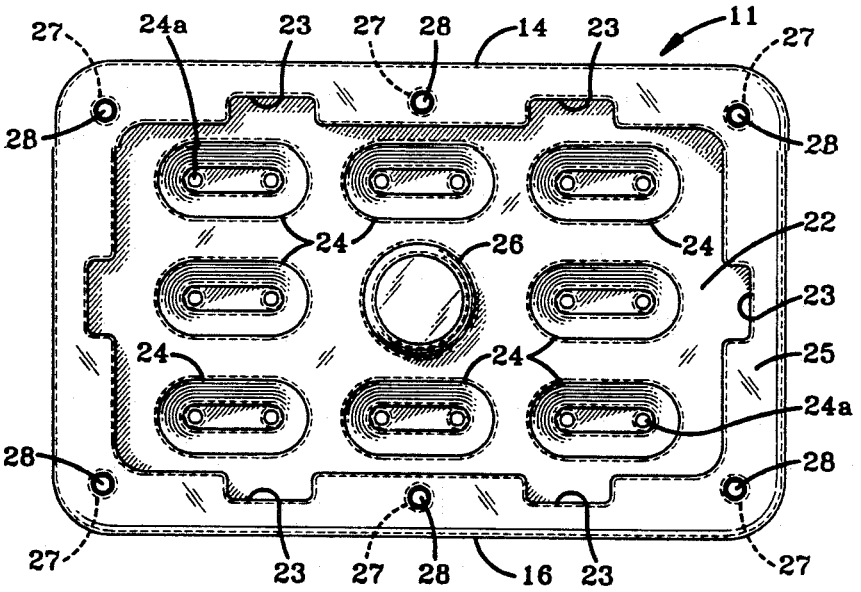
FIG. 6 is bottom plan view of the platform as shown in FIGS. 3–5.

As shown in FIG. 6, the lower extremities of the sidewalls terminate in a flat planar surface 25 which comprise the lower supporting surface of the top member. A series of indented rectangular recesses 23 are formed in the interior surfaces of the lower portions of the sidewalls at the junction with surface 25 to serve both a strengthening and locking function of the sidewalls to withstand weightsupporting loading pressure and extend generally horizontally outwardly into the hollow sidewalls. The intermediate planar wall surface 22 has a series of essentially equi-spaced hollow oval-shaped recesses 24 extending vertically between the intermediate lower planar wall surface 22 and the underside of the top surface 18. Preferably two small circular areas 24*a* of each of the oval recesses 24 are attached to the underside 13*a* of the top surface 13 to serve a strengthening function by their interconnection to the upper wall of the top member. In addition, a central region of the top member has a generally circular hollow recess 26 which extends beneath the underside of intermediate planar surface 22 and the bottom plane of the top member to strengthen the central region of the top surface to prevent bowing or warping of the top surface 13 when loaded or unloaded. The oval-shaped recesses 24, which are preferably eight in number, are thus interconnected to the underside of the top surface and the intermediate wall 22, to serve such strengthening function to prevent bowing or warping of the top surface when loaded in use by the weight of the participant or during the lifetime of the device.

Figure 5:
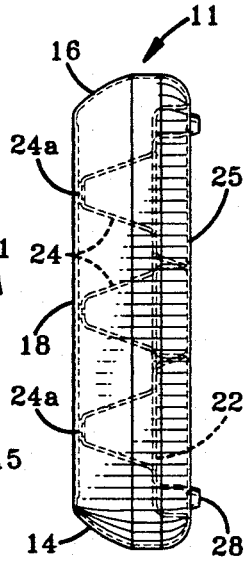
FIG. 5 is an end elevational view of the platform as shown in FIG. 3.
Figure 4:
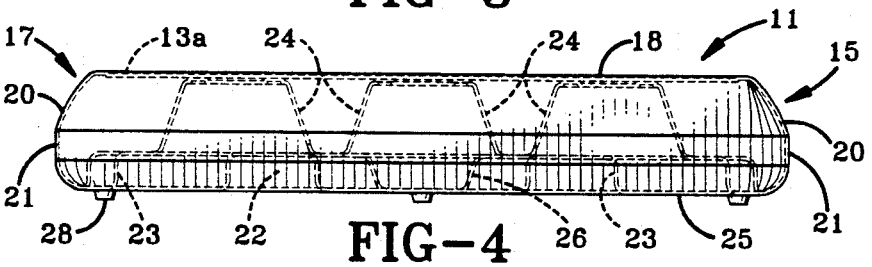
FIG. 4 is a side elevational view of the top platform.

FIGS. 4 and 5 show side elevational and end elevational views of the top member 11 and the generally rectangular and oval shaped recesses 23 and 24 which strengthen the hollow sidewalls and top surface of the top member. As stated, the top member is preferably formed of high-density polyethylene material having a uniform wall thickness of about 1/8 inch which may be conveniently blow-molded, the hollow top member having fully integral closed surfaces.

Figure 16:
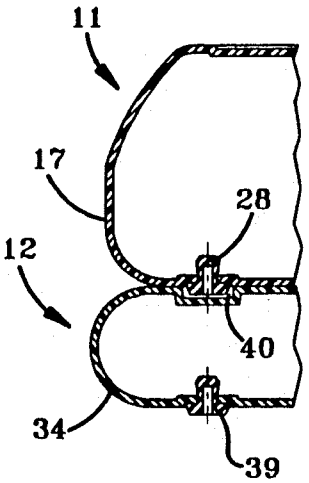
FIG. 16 is an enlarged fragmentary sectional view of the components of FIG. 15 in combined mating condition.
Figure 15:
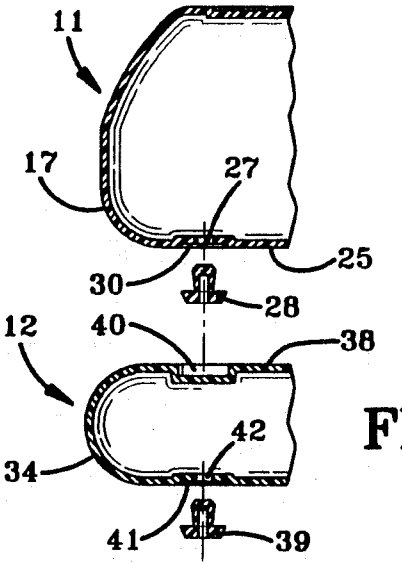
FIG. 15 is an enlarged fragmentary exploded perspective sectional view of the end portions of the top platform and base member prior to being joined with the corner grommets being removed therefrom.
Figure 18:
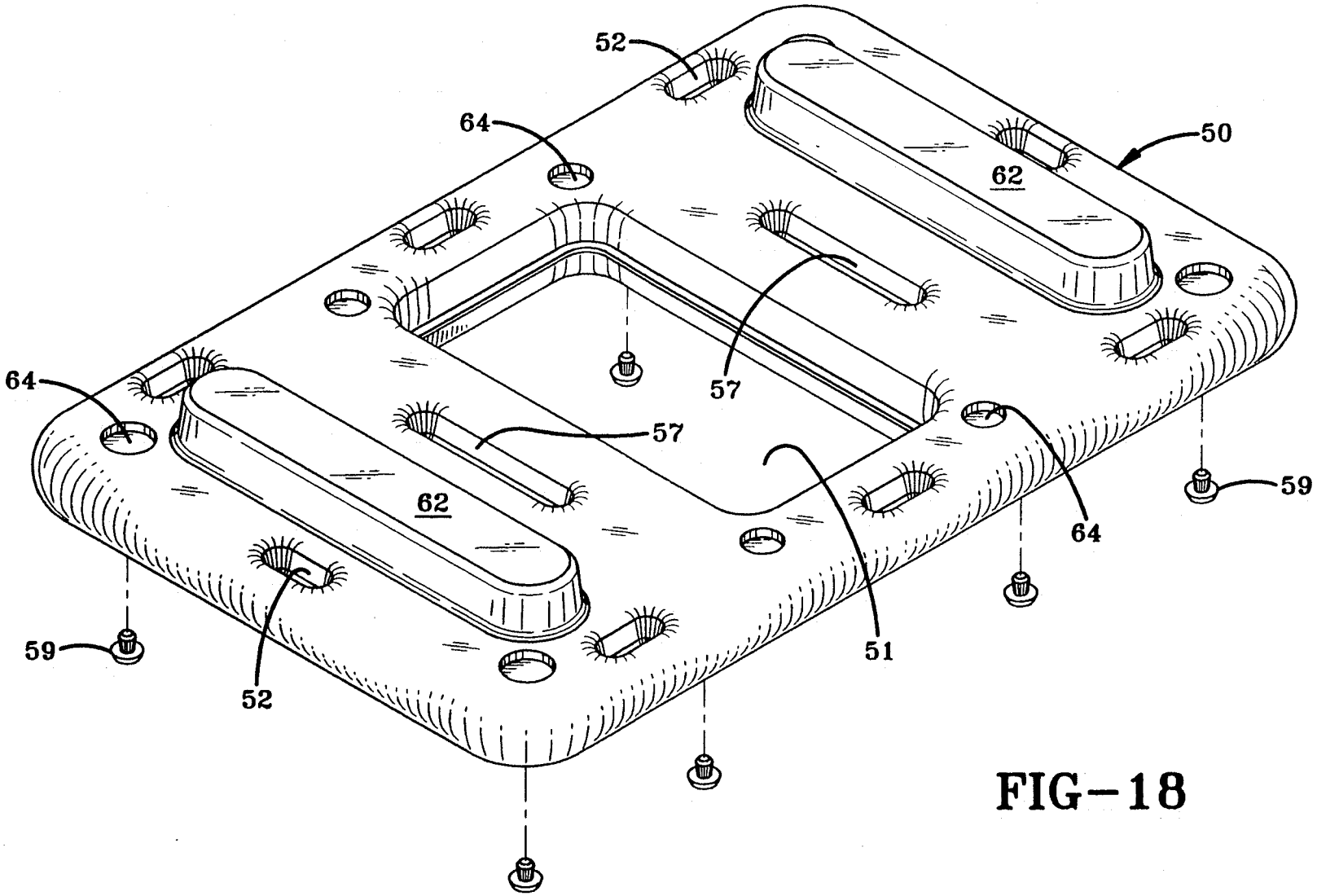
FIG. 18 is a perspective view with the grommets shown in exploded condition, of an additional base member which may be incorporated into the exercise platform of the invention shown in FIGS. 1–17.
Figure 20:
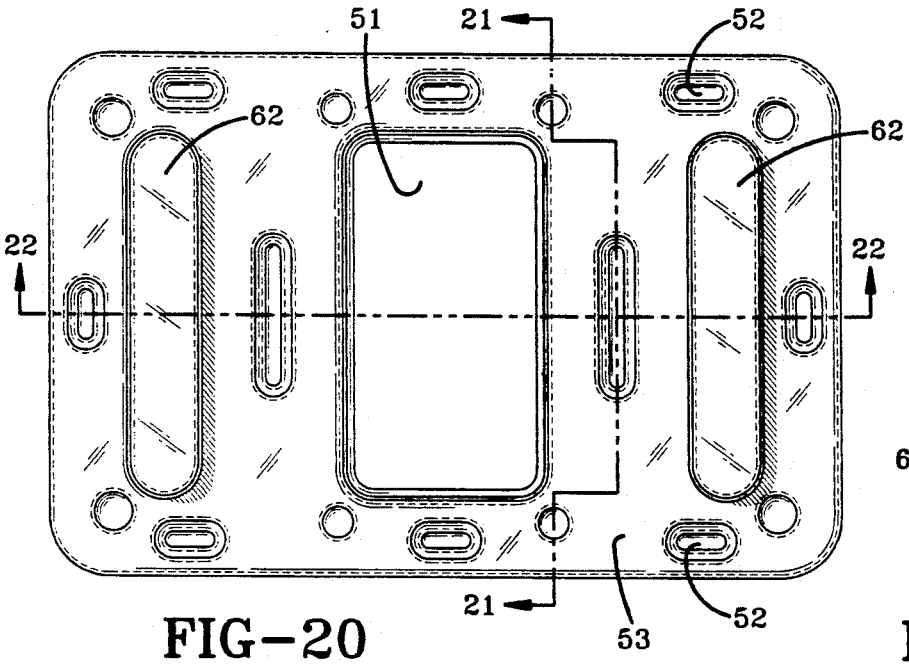
FIG. 20 is a top plan view of the base member of FIGS. 18 and 19.
Figure 21:
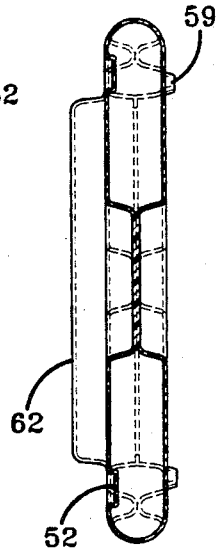
FIG. 21 is a sectional view taken on line 21—21, FIG. 20.
Figure 22:
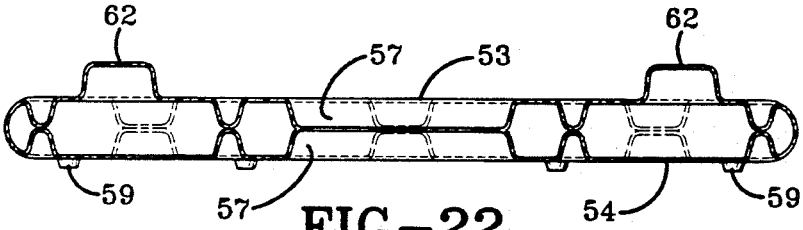
FIG. 22 is a sectional view taken on line 22—22, FIG. 20.
Figure 19:
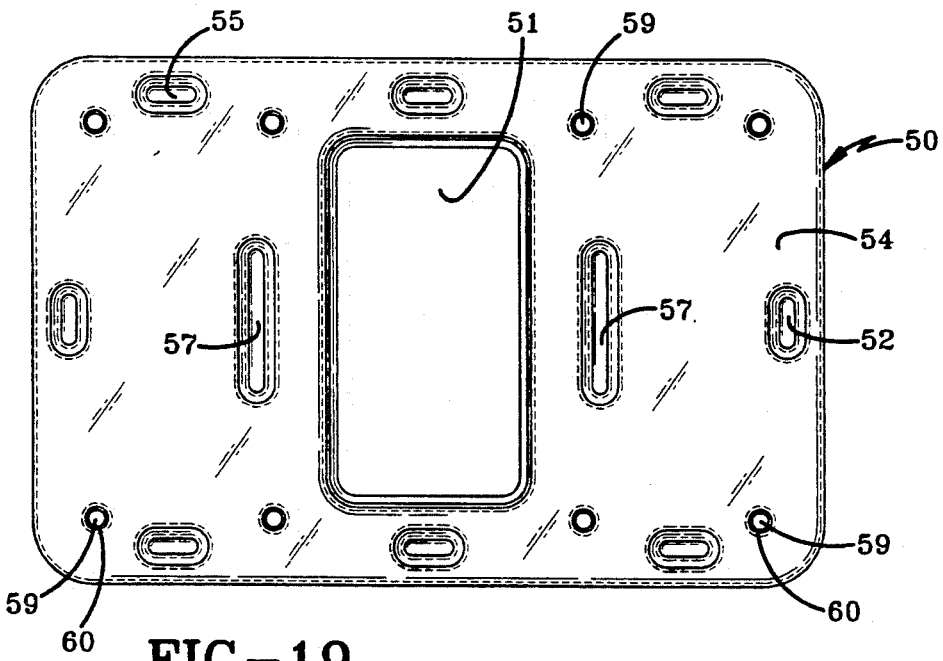
FIG. 19 is a bottom plan view of the additional base member of FIG. 18.

The underside lower of the essentially planar lower surface 25 formed by the lower extremities of the sidewalls of the top member have a series of multiple similar circular apertures 27 formed in the center of concentric recesses 30, into which rubber grommets 28 are snugly fitted to provide the lower planar surface with a non-slip characteristic (FIG. 15 and 16). The top member may be used alone on any kind of floor or surface, which resilient grommets 28 assist in maintaining the top member in stable non-slip condition. The top member thus provides a first riser step of about 4 inches in height which has been found to be a preferred vertical dimension for exercise participants having a lesser degree of fitness.

FIG. 6 shows the underside of top member 11 with the plurality of oval recesses 24 in both solid and dotted outline indicating the small circular areas 24*a* of attachment of the extremities of the recesses to the underside 13*a* of the top surface The small circular areas 24*a* may be attached by thermal fusion during blow molding of the top member. As stated, the circular post-type central member 26 formed in the underside of the top member extends from the underside of the intermediate wall 22 throughout the lower vertical extent of the top member and lies in the same horizontal plane as bottom surface 25 to provide a strong supporting central post. The top member is thereby a fully enclosed sealed hollow body which is lightweight, strong and durable for long-term use. The top member has a non-sliding feature for use on any type of floor or supporting surface. Such member may be employed individually or combinedly with the bottom member 12.

Figure 13:
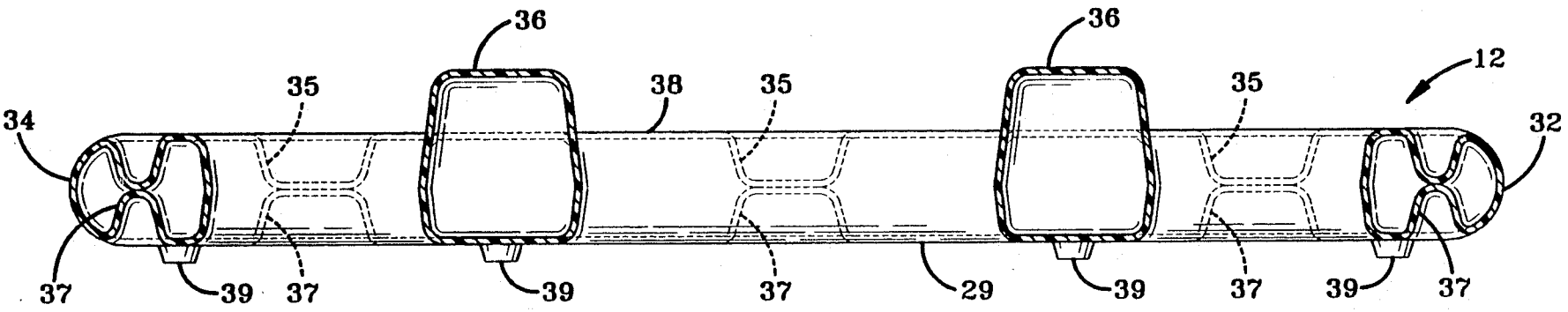
FIG. 13 is an enlarged sectional view of the base member taken on line 13—13, FIG. 7.
Figure 14:
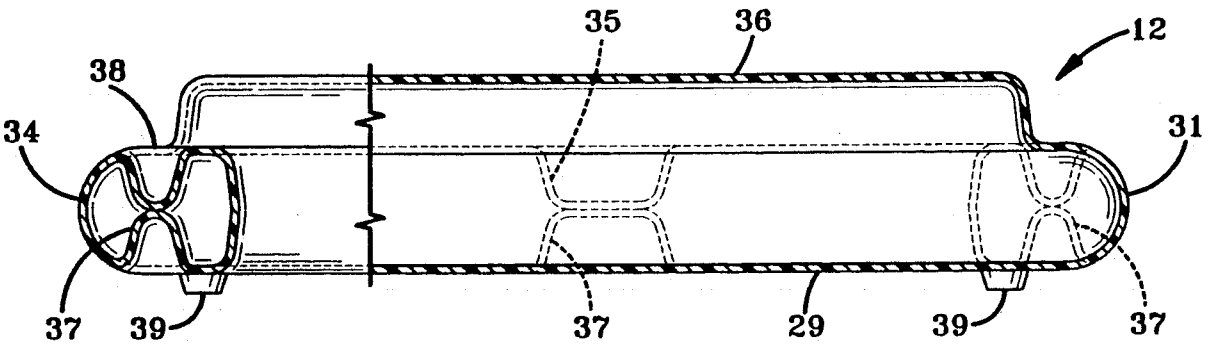
FIG. 14 is an enlarged sectional view of the base member taken on line 14—14, FIG. 7.

FIG. 2 is an exploded view showing in perspective the bottom member 12 of the device having a rectangular configuration and an essentially hollow interior as shown in FIGS. 13 and 14. The sidewalls of the lower member are complemental in shape and contour to the underside of the top member 11 and are configured to align and interlock therewith when in stacked relation. The sidewalls 31, 32, 33 and 34 of the lower member 12 are hollow double-thickness walls having a series of about eight recesses 35 formed in the upper center region of each of the sidewalls which form top surface 38 of member 12. Preferably three recesses are formed along each side of the longitudinal sidewalls 31 and 33 in their upper surface, and single recesses formed in the shorter dimension sidewalls 32 and 34. Eight similar recesses 37 are formed in bottom surface 29 of member 12 (FIG. 10) in vertical alignment with upper recesses 35.

Figure 9:
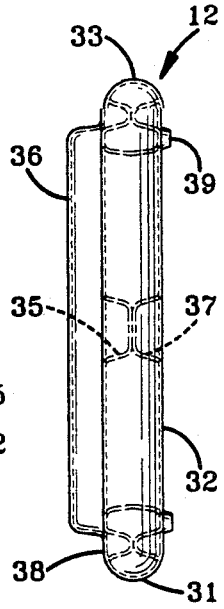
FIG. 9 is an end elevational view of the base member of FIG. 7.
Figure 17:
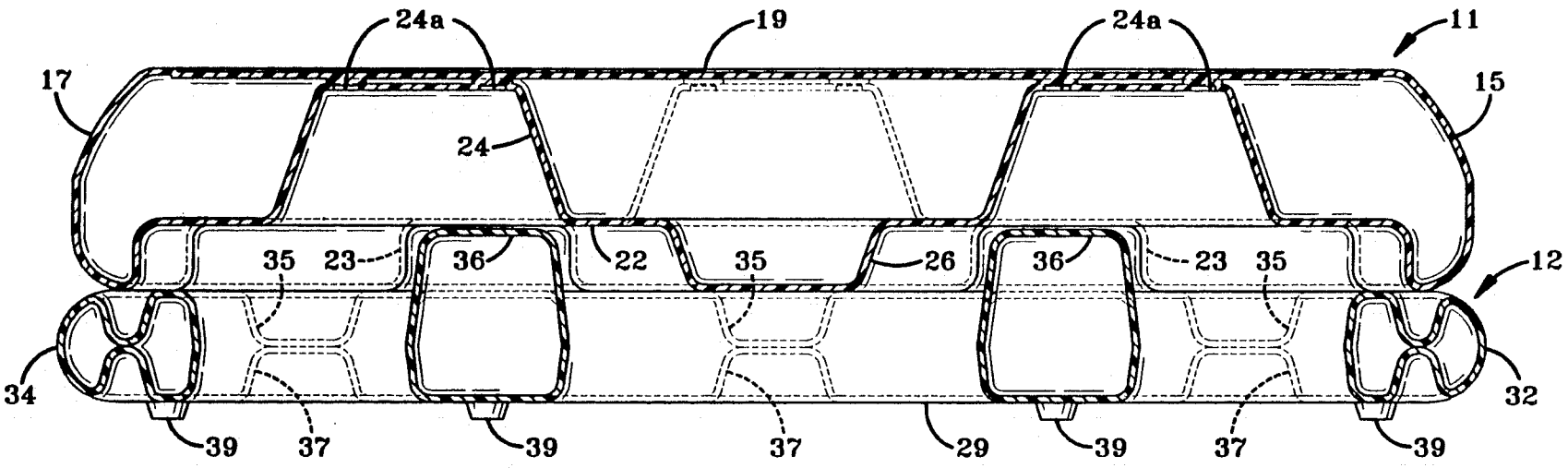
FIG. 17 is an enlarged sectional view of the combined top and bottom members showing the interlocking of the pair of rectangular ribs of the bottom member and the recesses of the top member.

In accordance with one of the features of the invention, a pair of upstanding rib members 36 having a generally rectangular configuration, are formed on upper surface 38 of the bottom member extending upwardly about ⅓ the vertical height of the bottom member sidewalls and above the plane of the sidewalls. The two spaced-apart ribs 36 (FIGS. 7–9) are parallel and have a transverse dimension shorter than the smaller dimension of the bottom member and are adapted to snugly fit into the juxtaposed pairs of rectangular horizontal recesses 23 formed interiorly of the lengthwise sidewalls of the top member as shown in FIG. 17. Ribs 36 are shaped to permit their being telescopically fitted within the juxtaposed recesses to prevent both lateral and rotational movement of the bottom member with respect to the top member when the two are combined vertically in interlocked relation. The ribs also serve a load-bearing strengthening function of the bottom member along with its recessed sidewalls to strengthen the device as well as providing the interlocking function when the top and bottom components are stacked.

Figure 7:
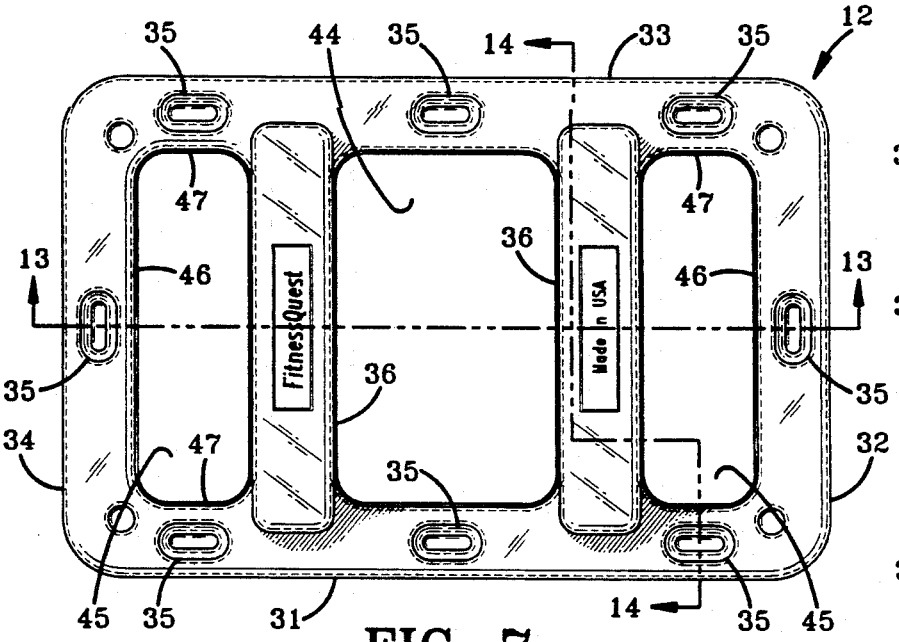
FIG. 7 is a top plan view of the base member.
Figure 8:
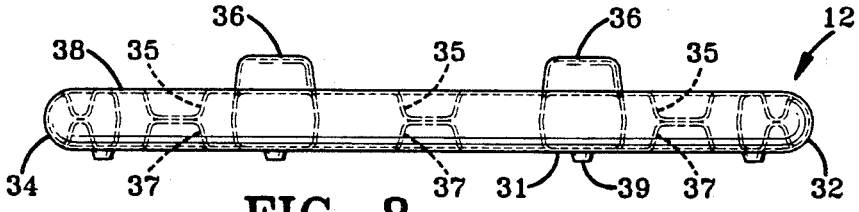
FIG. 8 is a side elevational view of the base member of FIG. 7.
Figure 10:
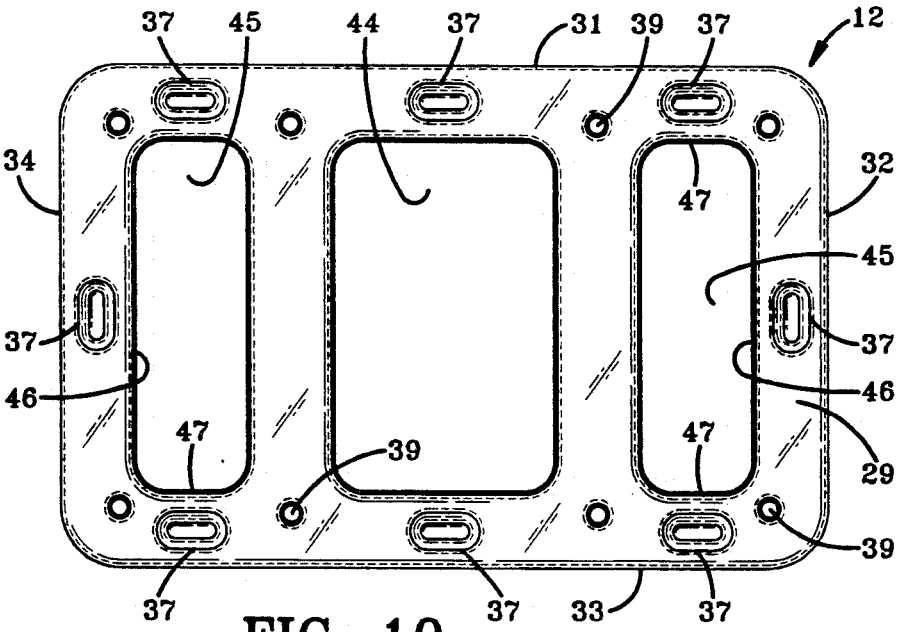
FIG. 10 is a bottom plan view of the base member.

The bottom member 12 is shown in FIGS. 7, 8, 9 and 10 with the rib members 36 extending upwardly beyond upper surface 38 of the bottom member sidewalls. The recesses 35 and 37 which are formed in both the upper and lower surfaces of the sidewalls of member 12 are interconnected by thermal fusion during blow molding to strengthen the sidewalls and are generally oval or rectangularly shaped as shown in FIGS. 7 and 10 of the drawings. The interconnection of the recessed portions in both the longitudinal and transverse end sidewalls in a central region of the lower member is shown in greater detail in FIGS. 8 and 9 of the drawings which are sectional views indicating how the juxtaposed recesses are interconnected when blow-molded to provide extremely strong sidewalls for greatest strength per unit weight. The lower surface 29 of the bottom member 12 comprised of the lowermost surfaces of the sidewalls and rib members is planar and rectangularly-shaped to support the sidewalls of the top member in face-to-face relation. The broad horizontal dimensions of the respective sidewalls provide heavy-duty support for exercisers up to about 350 pounds. The recessed sidewalls are shaped to provide substantial depth of section in both horizontal and vertical directions for heavy loading without flexure.

Base member 12 is formed with a central opening 44 and a pair of spaced adjacent openings 45. Openings 45 are of the same length as opening 44 but smaller in width. These openings reduce the overall weight of the base member and cost thereof due to less material being required for molding without loss of strength.

FIGS. 11 and 12 of the drawings are enlarged views of the top member which are comparable to smaller FIGS. 4 and 5 respectively which show in greater detail the oval configuration of the recesses and their small circular areas of interconnection to the underside of the top surface of the top member. The circular central recess 26 formed in the underside of the top member 12 is shown as to how it interconnects with the oval recesses for improved strengthening of the central portion of the top member.

FIGS. 13 and 14 show in enlarged detail the interconnection of the plurality of recesses 35 and 37 in the bottom member 12 and the upstanding pair of rib members 36 which serve to interconnect the bottom member with complemental recesses 23 in the top member for interlocking the two components together. Bottom member 12 comprises a hollow frame formed by the rectangular sidewalls with the pair of rib members 36 extending between the longitudinal sidewalls 31 and 33 and connecting the same. The ribs extend throughout the vertical extent of the bottom member and project upwardly a substantial dimension beyond the upper extremities of the sidewalls which form top surface 38 of member 12. The ribs serve both to strengthen the bottom or base member as well as the interlocking feature with the top member. The sidewalls and ribs are interconnected interiorly into the closed structure of the base member which is lightweight and very durable and extremely strong per unit weight.

FIG. 15 shows the corner apertures in both the top and bottom members 11 and 12 and how rubber grommets are inserted therewithin to provide both the top member and bottom member with non-slip characteristics when used either alone or in combination. A recess 41 is provided in multiple areas of bottom surface 29 of lower member 12 concentric with a circular aperture 42 for receiving a grommet 39 snug fitted therein. A recess 40 is provided in the upper surface of each corner region of the bottom member 12 to receive the aligned grommet 28 of top member 11 therein to assist in interlocking the two stacked components. The aligned grommets of the stacked components are shown in the relative seated relationships in FIG. 16 when the upper and lower members are combined. Thus, the essentially planar underside of the top member and top surface of the bottom member reside in face-to-face relation as shown in FIG. 17 with the resilient grommet members located within the four corner recesses in the upper region of the bottom member to assist in maintaining the interlocking function. The grommets are preferably mounted in vertical alignment to provide the lower surfaces of both the top and bottom members with non-slip characteristics, both when the top member is used alone and when the two components are used in combination. The mounting of grommets 28 and 39 in recesses 30 and 41 prevent the easy removal of the grommets by children since only the tapered side of the grommets are exposed and not the bottom surface. Therefore, children cannot get a good grip on the grommets to remove them preventing accidental choking. FIG. 17 shows in vertical section how the extremities of the two rib members 36 fit into the juxtaposed rectangular recesses 23 in the interior areas of the longitudinal sidewalls of the top member. Their surfaces are smoothly curved with mating contours to prevent lateral relative movements of the two units when stacked.

The platform may be readily assembled and disassembled by lifting the top member vertically and placing it on or taking it off the bottom member. No other fastening means are required other than their interlocking contours. The top and bottom members, when the top is used individually, or the two combinedly, have smooth gently curved and vertical side surfaces which do not interfere with the stepping exercise. The feet may be raised and lowered with precision as the participant steps forwardly and upwardly onto the device as well as downwardly off the device. The sidewalls provide clearance for the feet to prevent slipping or misstepping. Furthermore, as best shown in FIGS. 1 and 17, the aligned sidewalls of the top and bottom members provide for a continuous surface completely around all sides of the platform eliminating overhanging areas or areas of the top surface not continuous to the floor upon which the user can catch his or her toe to cause tripping, especially as the user tires near the end of the exercise routine. Likewise, the top and bottom members have complemental rectangular dimensions of about 15 by 24 inches thereby providing a large enough top surface for comfortably and safely performing the desired exercise routine.

A further embodiment of the invention is shown in FIGS. 18–23 and includes a second or bottom most base member indicated generally at 50. Base member 50 is generally similar to base member 12 in that it is formed preferably as a hollow blow molded member having a reinforced interior and double thickness walls as is easily seen by comparison of FIGS. 21 and 22 with that of FIG. 8. Base member 50 includes a central opening 51 and is formed with a series of elongated oval shaped recesses 52 in both the upper and lower surfaces 53 and 54, respectively, which are joined together at 55 in the interior of member 50 to provide the necessary reinforcement for member 50. A pair of larger oval shaped reinforcing recesses 57 are formed in the upper and lower surfaces adjacent central opening 51.

A plurality of grommets 59 similar to grommets 39, are mounted within associated recesses 60 formed in bottom surface 54. Preferably eight grommets and associated recesses will be used to provide a very stable non-slip support for base member 50 and top member 11 and bottom member 12 when mounted thereon.

Figure 23:
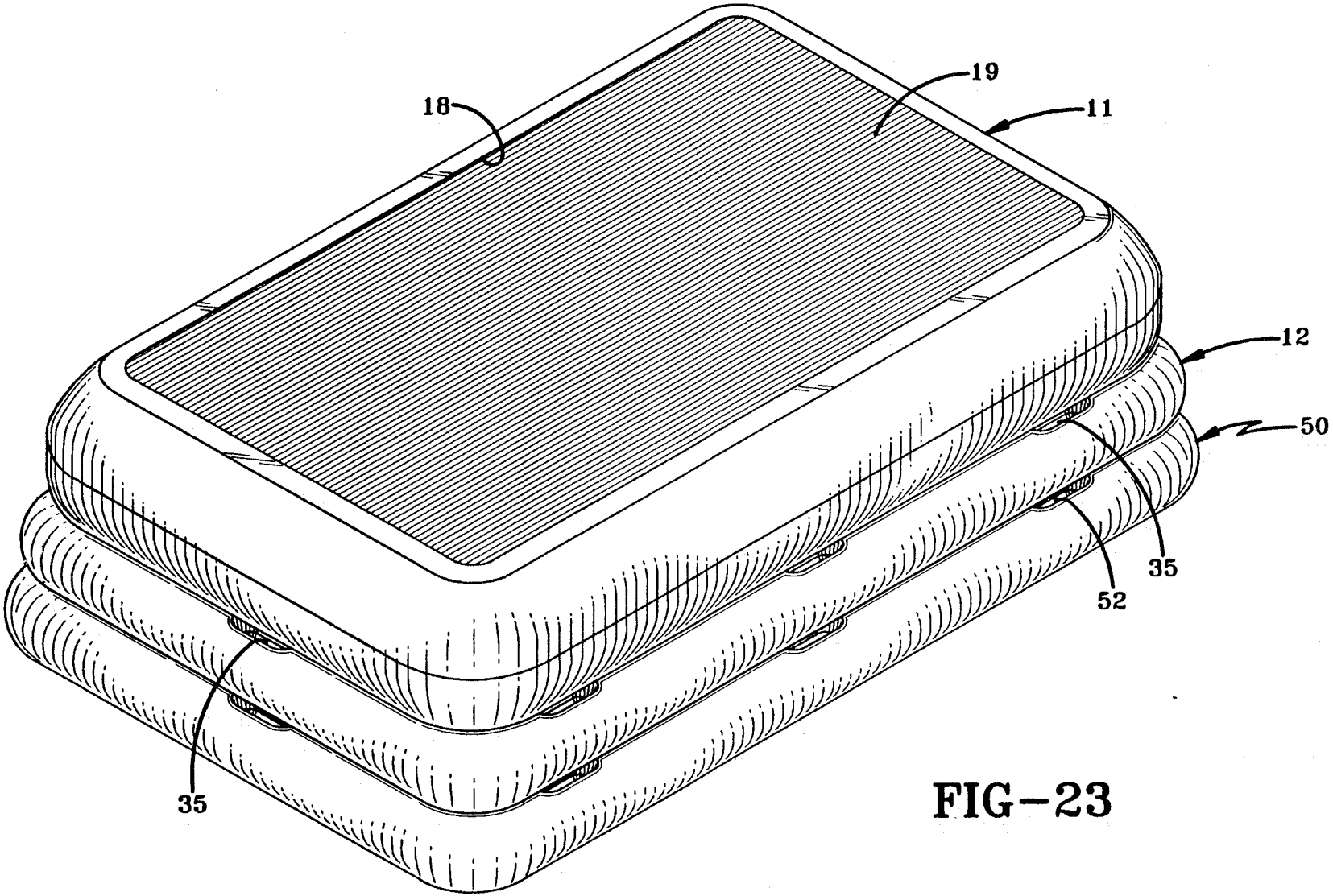
FIG. 23 is an enlarged perspective view similar to FIG. 1 of the exercise platform incorporating the additional base member of FIG. 18 therein.

In further accordance with the invention, a pair of spaced parallel upstanding rib members 62 having generally rectangular configurations similar to rib members 36, are formed integrally with top surface 53 and extend upwardly about ⅓ the vertical height of member 50. Ribs 62 extend into spaced openings 45 of base member 12 when incorporated therewith into a stacked configuration as shown in FIG. 23, and abut the outer longitudinal edges 46 and end edges 47 of openings 45 to innerlock member 50 with member 12. This innerlocking provide for a rigid three layer structure as shown in FIG. 23, and prevents any horizontal sideways movement between members 12 and 50 in any direction.

Member 50 can only be used when member 12 is supporting top member 11, and is used to increase the overall height of the structure by an additional amount such as two inches, when used by a better conditioned person. Again smooth and continuous side and end regions are provided to reduce the possibility of a user catching a toe on an overhanging portion as in prior art platform exercisers.

A plurality of circular recesses 64 are formed on top surface 53 of member 50 and align with grommets 39 of base member 12 for receiving the grommets therein, to provide for increased support and stability of the stacked members.

Accordingly, the improved exercise platform is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitation are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise platform is constructed and used, the characteristics of the construction, and the advantageous, new and useful results obtained; the new and useful structures, devices, elements, arrangements, parts and combinations, are set forth in the appended claims.

We claim:

1. In combination, a two-piece exercise platform for use in step-aerobic exercises comprising a rectangular hollow top member of substantial thickness having a generally planar upper surface and substantially double-thickness integral hollow peripheral vertical sidewalls with a plurality of internal hollow recesses therein and a hollow central portion extending throughout the vertical extent of said top member beneath said upper surface providing a weight-supporting first riser step of said platform capable of individual use, and a complemental rectangular hollow bottom member having double-thickness integral hollow peripheral vertical sidewalls providing a weight-supporting second riser step of said platform and having at least one pair of upstanding horizontal rib members adapted to telescopically engage within said internal recesses in said top member providing an interlocked structure when stacked with said top member.

2. The combination in accordance with claim 1, wherein said top member is disposed in partially interlocked relation with said bottom member to prevent relative lateral movement of said top and bottom members when combined in stacked relation.

3. The combination in accordance with claim 2, wherein said top member and said bottom member have generally complemental rectangular dimensions and substantially vertical side surfaces for their partial internal telescopic engagement; and in which said side surfaces provide a substantially continuous surface completely about the periphery of the platform.

4. The combination in accordance with claim 1, wherein the bottom surface of said top member and the upper surface of said bottom member are planar for face-to-face load-bearing contact, said top member having a first riser step height of about 4 inches and said top and bottom members when stacked having a second riser step height of about 6 inches.

5. The combination in accordance with claim 1, wherein both said top member and said bottom member are separately formed by blow molding from high-density polyethylene plastic material.

6. The combination in accordance with claim 1, wherein the said pair of upstanding horizontal rib members of said bottom member are rectangular in shape, said top member having a series of four internal hollow recesses generally rectangular in shape formed interiorly within said sidewalls adapted to receive and retain the ends of said rib members of said bottom member in interlocked relation.

7. The combination in accordance with claim 1, wherein the said top member has a vertical height of about 4 inches and said bottom member has a vertical height of about 2 inches, both said top and bottom members of said platform having complemental rectangular dimensions of about 15 by 24 inches.

8. The combination in accordance with claim 1, wherein both said top and bottom members of said platform are formed of blow-molded polyethylene plastic material having a substantially uniform thickness of their body parts and sidewalls of about ⅛ inch.

9. The combination in accordance with claim 1, wherein the said generally planar upper surface of said top member has a substantially rectangular shallow recess therein with a ribbed mat of elastomeric material securely mounted therein for sure footing during step-aerobic exercises.

10. The combination in accordance with claim 1 wherein said bottom member is formed with a pair of spaced openings; and in which a second hollow bottom member is formed with a pair of spaced upstanding rib members which extend into the spaced openings of said bottom member providing an interlocked structure when the two-piece platform is stacked with the second bottom member.

11. The combination in accordance with claim 10 wherein the ribs of the second bottom member have a length generally equal to the length of the spaced openings of the said first bottom member.

12. The combination in accordance with claim 10 wherein the said bottom member has a plurality of grommets extending downwardly from a bottom surface thereof; and in which a top surface of the second bottom member is formed with a plurality of recesses for receiving the grommets of the said bottom member therein.

13. In combination, a two-piece exercise platform for use in step-aerobic exercises comprising a rectangular hollow top member of substantial thickness having a generally planar upper surface and substantially double-thickness integral hollow vertical sidewalls with a plurality of spaced-apart internal hollow recesses therein and a hollow central vertical wall portion beneath said upper surface extending throughout the vertical extent of said top member providing a weight-supporting first riser step of said platform capable of individual use, a complemental rectangular hollow bottom member of lesser thickness than said top member having doublethickness integral hollow peripheral vertical sidewalls having a plurality of internal recesses therein to strengthen said bottom member, said top and bottom members having facing planar surfaces for surface-to-surface load-supporting contact when stacked to provide a second higher riser step, and interlocking means of said top and bottom members consisting essentially of at least one pair of upstanding rectangular rib members in the upper surface of said bottom member adapted to engage at least two pairs of internal recesses formed internally in the sidewalls of said top member to prevent both lateral and rotational relative movement of said top and bottom members when combined in stacked relation.

14. The combination in accordance with claim 13, wherein the said central hollow portion is circular in shape having substantially vertical sidewalls extending throughout the full vertical height of said top member for central support of the planar top surface of said top member when used alone.

15. The combination in accordance with claim 13, wherein the said hollow recesses in the underside of said planar top surface of said top member consist essentially of generally about 8 oval-shaped recesses with circular areas of each joined to said underside of said planar top surface to support said planar top surface in load-bearing relation without warpage.

16. The combination in accordance with claim 1, wherein said top member and said bottom member have substantially complemental rectangular dimensions and substantially vertical side surfaces when stacked in interlocking relation.

17. The combination in accordance with claim 13, wherein both said top member and said bottom member are separately formed by blow-molding from high-density polyethylene plastic material, both said top and bottom members having complemental rectangular dimensions of about 15 by 24 inches.

18. The combination in accordance with claim 13, wherein the said planar upper surface of said top member has a generally rectangular shallow recess therein extending substantially throughout said upper surface with a ribbed mat of elastomeric material securely mounted completely therein for sure footing during step-aerobic exercises.

19. The combination in accordance with claim 13, wherein the integral body portions and sidewalls of said top and bottom members are formed of blow-molded polyethylene plastic material having a substantially uniform thickness of about $\frac{1}{8}$ inch.

20. The combination in accordance with claim 1, wherein said top member and said bottom member have interfacing planar surfaces for positive face-to-face load-bearing contact when stacked, said top member having a first riser step height of about 4 inches and said top and bottom members when stacked having a second riser step height of about 6 inches.

21. The combination in accordance with claim 13, wherein both said top and bottom members have circular recesses formed in corner areas of their lowermost surfaces; and in which load-supporting non-slip rubber grommet members are mounted in said recesses for individual use of said top member alone and combination use of both said members.

22. The combination in accordance with claim 13, wherein said top member and said bottom member have substantially complemental rectangular dimensions of about 15 by 24 inches, substantially vertical exterior side surfaces and mating internal surfaces for their internal telescopic engagement in stacked relation.

23. The combination in accordance with claim 13, wherein the bottom surface of said top member is planar and formed by the peripheral sidewalls of said top member, and the top surface of said bottom member is planar and formed by the peripheral sidewalls of said bottom member, said members adapted to stacked face-to-face load-bearing contact of their relative sidewalls to provide said second higher riser step of said platform.

* * * * *